US009926160B2

(12) United States Patent
Macura et al.

(10) Patent No.: US 9,926,160 B2
(45) Date of Patent: Mar. 27, 2018

(54) ROBOTIC UNWIND STAND

(71) Applicant: The Procter & Gamble Company, Cincinnati, OH (US)

(72) Inventors: Matthew Joseph Macura, Loveland, OH (US); Rong Deng, Mason, OH (US); Craig Allen Powell, Independence, KY (US)

(73) Assignee: The Procter & Gamble Company, Cincinnati, OH (US)

( * ) Notice: Subject to any disclaimer, the term of this patent is extended or adjusted under 35 U.S.C. 154(b) by 483 days.

(21) Appl. No.: 14/669,414

(22) Filed: Mar. 26, 2015

(65) Prior Publication Data

US 2016/0060062 A1 Mar. 3, 2016

Related U.S. Application Data

(63) Continuation-in-part of application No. 14/471,315, filed on Aug. 28, 2014.

(51) Int. Cl.

| | |
|---|---|
| ***B65H 19/18*** | (2006.01) |
| ***B65H 16/10*** | (2006.01) |
| ***B65H 19/14*** | (2006.01) |
| ***B65H 19/12*** | (2006.01) |
| ***B65H 75/24*** | (2006.01) |

(52) U.S. Cl.

CPC ..... *B65H 19/18* (2013.01); *B65H 16/10* (2013.01); *B65H 19/123* (2013.01); *B65H 19/14* (2013.01); *B65H 19/1805* (2013.01); *B65H 75/242* (2013.01)

(58) Field of Classification Search

CPC ..... B65H 19/18; B65H 75/242; B65H 16/10; B65H 19/14; B65H 19/1805; B65H 19/123; B65H 2301/41826

See application file for complete search history.

(56) References Cited

U.S. PATENT DOCUMENTS

| | | | |
|---|---|---|---|
| 3,836,089 | A | 9/1974 | Riemersma et al. |
| 4,331,418 | A | 5/1982 | Klebe |

(Continued)

FOREIGN PATENT DOCUMENTS

| | | | |
|---|---|---|---|
| CN | 102648139 | A | 8/2012 |
| DE | 4041865 | A1 | 7/1992 |

(Continued)

OTHER PUBLICATIONS

PCT International Search Report, dated Jan. 26, 2016, 92 pages.

(Continued)

*Primary Examiner* — William A. Rivera
(74) *Attorney, Agent, or Firm* — Sarah M. DeCristofaro

(57) ABSTRACT

A web unwind stand for obtaining, loading, splicing, and unwinding convolutely wound rolls of web material and forwarding the web material unwound from each of the convolutely wound rolls uninterruptedly to a downstream apparatus is disclosed. The unwind stand comprises splicing means, a first positionable roll grasping apparatus for obtaining and disposing a first of the convolutely wound rolls proximate to, and relative to, the splicing means, and, second positionable roll grasping apparatus for obtaining and disposing a second of the convolutely wound rolls proximate to, and relative to, the splicing means.

16 Claims, 7 Drawing Sheets

(56) References Cited

U.S. PATENT DOCUMENTS

| | | | | |
|---|---|---|---|---|
| 4,726,725 | A | 2/1988 | Baker et al. | |
| 4,733,576 | A | 3/1988 | Zimmer et al. | |
| 5,305,652 | A | 4/1994 | Zimmer | |
| 5,474,251 | A * | 12/1995 | Neri | A24C 5/20 242/554.2 |
| 6,116,669 | A * | 9/2000 | Scaglia | B65H 67/0411 242/559.1 |
| 6,604,704 | B2 * | 8/2003 | Kiprowski | B65H 3/0816 242/559 |
| 6,685,130 | B2 | 2/2004 | Stauber et al. | |
| 6,731,091 | B2 | 5/2004 | Hietmann et al. | |
| 6,736,348 | B1 | 5/2004 | Formon et al. | |
| 6,767,318 | B2 | 7/2004 | Spatafora et al. | |
| 6,978,964 | B2 | 12/2005 | Beccari | |
| 7,350,740 | B2 | 4/2008 | Benvenuti et al. | |
| 7,984,603 | B2 * | 7/2011 | Freudenberg | B65H 19/123 242/559 |
| 8,219,245 | B2 | 7/2012 | Merk et al. | |
| 2006/0043231 | A1 * | 3/2006 | Tellier | B21C 47/30 242/573.7 |
| 2009/0294572 | A1 * | 12/2009 | Marcelli | B65H 49/30 242/571.3 |
| 2010/0294876 | A1 * | 11/2010 | Smith | B65H 19/2238 242/523.1 |
| 2012/0267467 | A1 | 10/2012 | Okabe | |
| 2013/0056576 | A1 * | 3/2013 | Andrews | A61F 13/15577 242/560 |
| 2015/0090831 | A1 * | 4/2015 | Huber | B65B 21/245 242/555.3 |
| 2016/0060060 | A1 | 3/2016 | Macura et al. | |

FOREIGN PATENT DOCUMENTS

| | | | |
|---|---|---|---|
| EP | 1798174 | B1 | 2/2013 |
| EP | 2412348 | B1 | 3/2014 |
| JP | 2005/138938 | A | 6/2005 |
| JP | 4089591 | B2 | 5/2008 |

OTHER PUBLICATIONS

U.S. Appl. No. 14/669,489, filed Mar. 26, 2015, Macura, et al.
U.S. Appl. No. 14/471,315, filed Aug. 28, 2014, Macura, et al.
U.S. Appl. No. 14/471,355, filed Aug. 28, 2014, Macura, et al.

* cited by examiner

ROBOTIC UNWIND STAND

FIELD OF THE INVENTION

The present disclosure relates generally to providing an apparatus for continuously forwarding a web material, such as polyethylene into a web consuming apparatus such as a converter used for manufacturing disposable absorbent articles such as diapers and catamenial devices. The present disclosure more particularly relates to equipment suitable for the un-assisted loading and unloading of a convolutley wound roll of web material taken from a supply of the convolutely wound rolls to a position where unwinding the convolutely wound material can produce disposable absorbent articles such as diapers and catamenial devices.

BACKGROUND OF THE INVENTION

In order to continuously supply a web consuming apparatus with web from a succession of rolls of web material, each new roll must be spliced to the preceding roll. Desirably, this is done without diminishing the rate of forwarding web to the web consuming apparatus. As such, a continuous supply of convolutely wound rolls of web material must be supplied to the apparatus in order to maintain the manufacturing speeds necessary for the production of disposable absorbent articles such as diapers and catamenial devices.

Today, in most manufacturing sites, manual operation remains the most common method for material handling and delivery. In most operations, the assembled products materials are processed on-line as webs and a vast majority of these web materials are brought to the line as planetary rolls of convolutely wound rolls of web material.

It will also be appreciated that raw material handling accounts for 30-50% of operational tasks across an assembled products manufacturing line today. This includes delivery, staging, roll preparation, and loading. Additionally, increasing line speeds increases the frequency of roll changes and drives higher operational efforts. In short, the manual loading of roll materials into an assembled products line is often found to be cost prohibitive.

Further, the floor space necessary today for unwind stands and raw material staging is roughly equal to the space necessary for the placement of an assembled goods converting operation. Additionally, future innovation tends to bring more complex assembled goods products and requires significantly more web materials. This can confound current manufacturing operations as floor space is likely fully used already. Therefore, finding additional floor space to accommodate both the existing assembled products lines and the expanded requirements to accommodate these additional lines is problematic.

Some solutions to this issue have been to utilize additional floor space to incorporate automation solutions. Floor space is at a premium. Current automation solutions provide significant safety concerns due to the increased risk of human injury or equipment damage. Others have provided additional equipment formats such as festooning, traversing wound rolls, and the like to extend roll life and reduce manual effort required to load such materials. However, these solutions only work for a limited range of materials.

There is a compelling need to eliminate the manual effort required to stage, prepare, load, and thread up web materials to feed the converting equipment to manufacture assembled goods such as catamenial devices and diapers. There is a compelling need to reduce the floor space required for material staging, preparation, loading, and unwind convolutely wound materials, inclusive of automation. Further, there is a compelling need to enable a 'lights-out' web material supply solution that is nearly capital equal to current unwind operations. Additionally, there is a compelling need to support agile manufacturing principles on converting lines that enable easy reconfigurability. Thus, it would be beneficial to solve these challenges of footprint, effort, and cost simultaneously. The present description solves these challenges.

SUMMARY OF THE INVENTION

The present disclosure relates to a web unwind stand for obtaining, loading, splicing, and unwinding convolutely wound rolls of web material and forwarding the web material unwound from each of the convolutely wound rolls uninterruptedly to a downstream apparatus. The unwind stand comprises splicing means, a first positionable roll grasping apparatus for obtaining and disposing a first of the convolutely wound rolls proximate to, and relative to, the splicing means, and, second positionable roll grasping apparatus for obtaining and disposing a second of the convolutely wound rolls proximate to, and relative to, the splicing means.

The present disclosure also relates to a web unwind stand for obtaining, loading, splicing, and unwinding web material from a succession of convolutely wound rolls of web material and forwarding the web material unwound from each of the convolutely wound rolls uninterruptedly to a downstream apparatus at substantially constant velocity under substantially constant tension. The apparatus comprises a frame, splicing means, a first positionable roll grasping apparatus having a mandrel associated thereto for disposing a first of the convolutely wound rolls proximate to the splicing means relative to the frame, and, a second positionable roll grasping apparatus for obtaining and disposing a second of the convolutely wound rolls proximate to the splicing means relative to the frame.

DETAILED DESCRIPTION

As will be described in detail, the exemplary robotic unwind stand 10 described herein can be used to simultaneously deliver a plurality of web materials to downstream manufacturing equipment. As is to be appreciated, the multiple robotic unwind stand 10 described herein can be configured to all simultaneously supply web material to a single downstream manufacturing process and/or a plurality of downstream manufacturing processes. The robotic unwind stand 10 described herein may be positioned in a manufacturing environment proximate to other manufacturing equipment. While no particular downstream equipment is shown, it will be understood by those of skill in the art that the continuous supply of web material from convolutley wound rolls of web material supplied by the robotic unwind stand 10 could be advanced to a variety of web material handling processes, including without being limiting, laminating operations, printers, embossing operations, slitting operations, folding and cutting operations, converting operations, and the like, as well as combinations of these.

Figure 1:
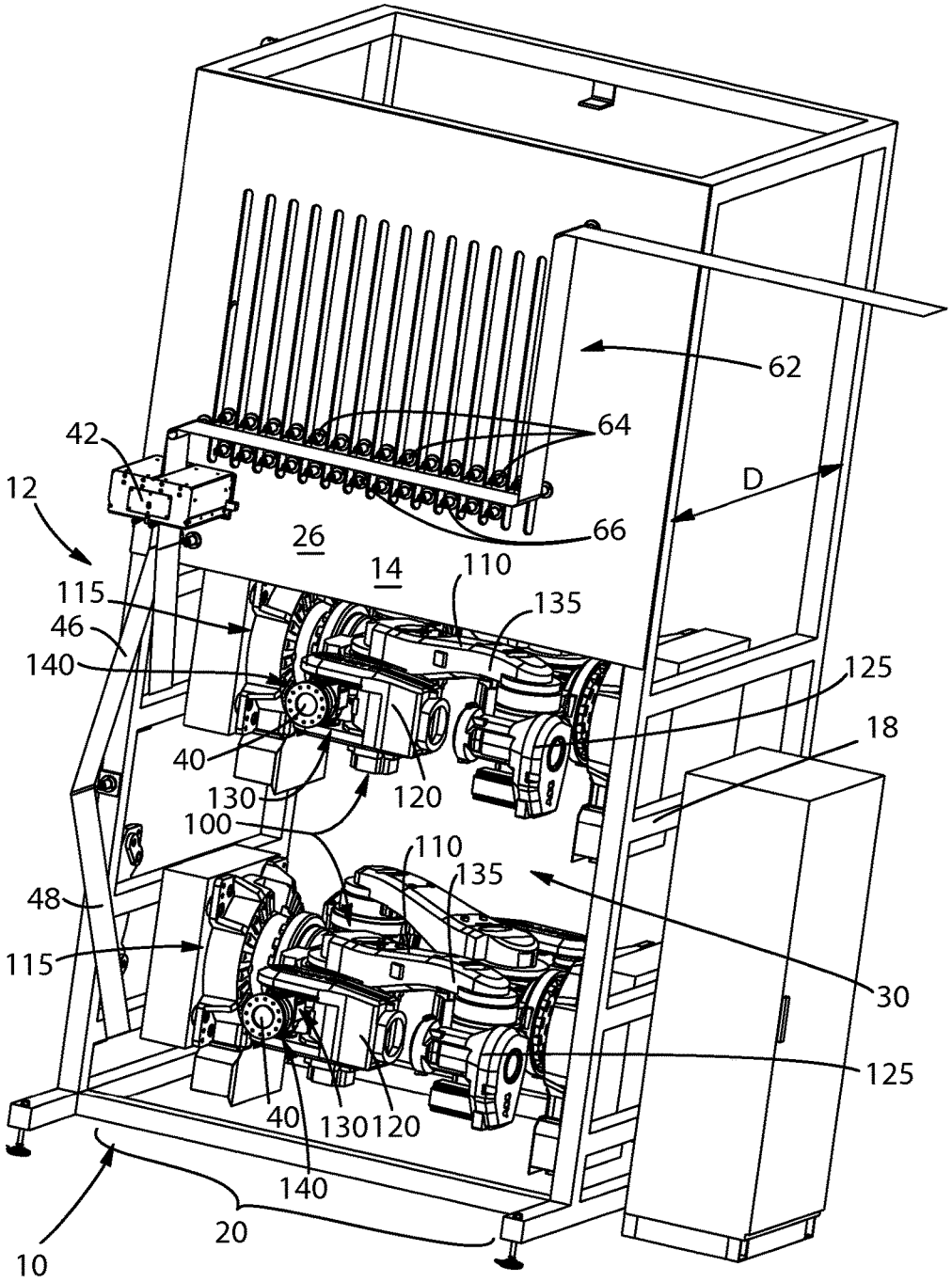
FIG. 1 is a perspective view of an exemplary robotic unwind stand according to the present disclosure showing a plurality of positionable roll grasping apparatii in the form of exemplary 6-axis robots disposed integrally with the frame and a first lattice disposed thereabove.
Figure 2:
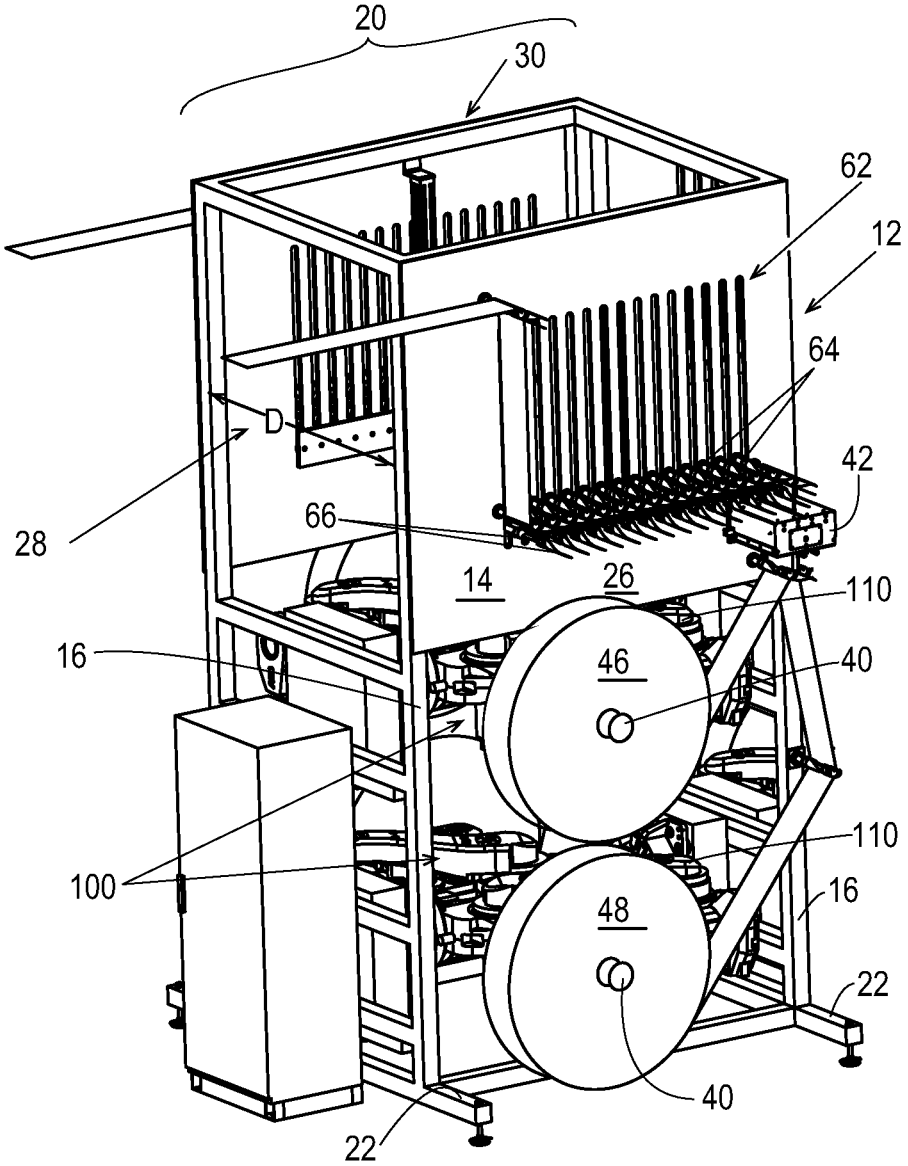
FIG. 2 is a perspective view of an exemplary robotic unwind stand according to the present disclosure showing a plurality of positionable roll grasping apparatii in the form of exemplary 6-axis robots disposed integrally with the frame each having a convolutley wound web material disposed thereon and a first lattice disposed above the rolls of convolutely wound web material.
Figure 3:
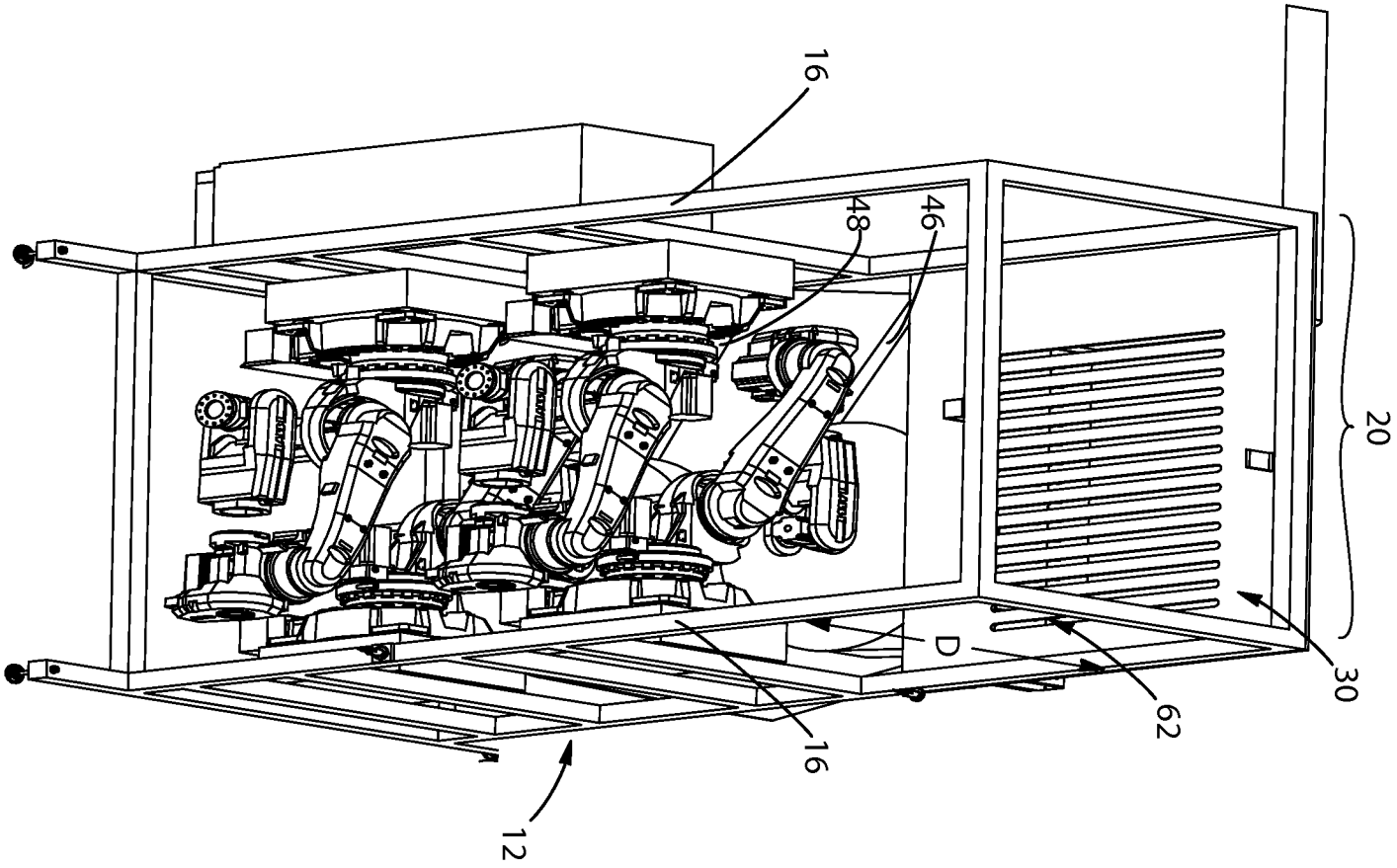
FIG. 3 is a perspective view of the back side of the exemplary robotic unwind stand of FIG. 2.
Figure 4:
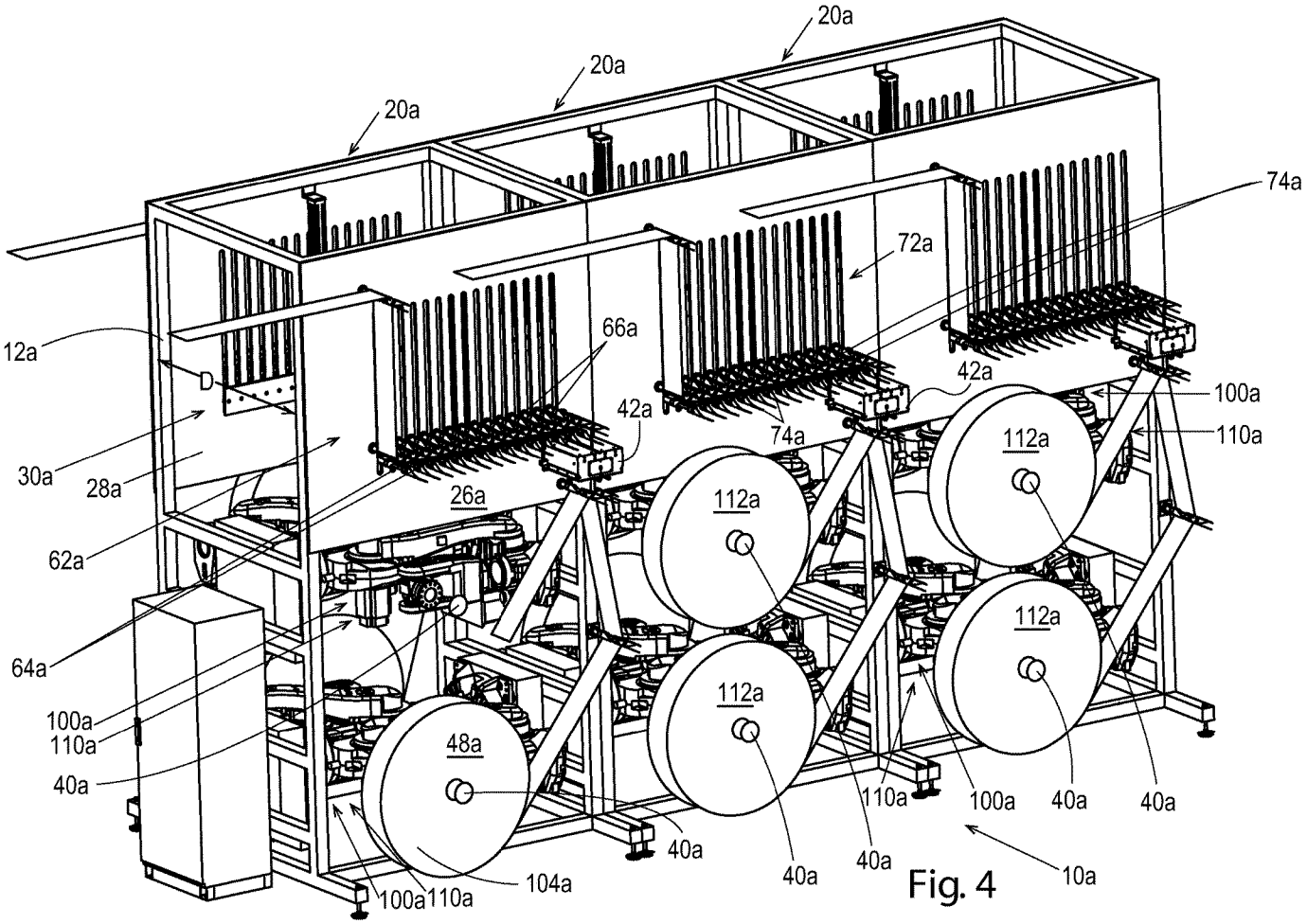
FIG. 4 is a perspective view of an alternative embodiment of an exemplary robotic unwind stand according to the present disclosure showing a plurality of unit operations each having a plurality of positionable roll grasping apparatii in the form of a plurality of exemplary 6-axis robots disposed integrally with the frame and each having a convolutley wound web material disposed thereon and a first lattice disposed thereabove.

One embodiment of the robotic unwind stand 10 is illustrated in FIGS. 1-3. FIGS. 1-3 are various perspective views of the robotic unwind stand 10 in accordance with one non-limiting embodiment. In the detailed embodiment of FIGS. 1-3, the robotic unwind stand 10 is provided with a frame 12. The frame 12 includes various components, such as structural supports and plates. For example, the frame 12 may include a plurality of faceplates 14. The faceplates 14 may be fastened to a support member 16 of the frame 12, for example. The frame 12 may include at least one cross-support member 18. The frame 12 can be provided as generally sectional, for example, section 20. It would be appreciated by one of skill in the art that other embodiments may comprise more or less sections. Furthermore (as shown in FIG. 4), the sections 20 may be arranged horizontally (as illustrated) or in a vertical arrangement, or a combination of both. The combination of a plurality of sections 20 can provide a robotic unwind stand 20 suitable for providing at least two, or at least 3, or at least 4, or at least 5, or at least 6 web materials each from a respective roll of convolutely wound web material to a downstream manufacturing operation as discussed supra.

The robotic unwind stand 10 may be manufactured from any suitable materials, such as steel, stainless steel, aluminum, cast iron, or composite materials, for example. The components comprising robotic unwind stand 10 may also be assembled or constructed using any suitable techniques, such as welding, rivets, adhesives, or screws, for example to provide an assembled robotic unwind stand 10.

The robotic unwind stand 10 may include a plurality of feet 22 arranged proximate the bottom side. As will be appreciated, the plurality of feet 22 may be adjustable in order to adjust the elevation of the robotic unwind stand 10. The robotic unwind stand 10 may allow for transport of a robotic unwind stand 10. Furthermore, the robotic unwind stand 10 may comprise a cable tray for housing various power and communication cables. Other techniques may be used for housing the cables, such as conduits, for example.

As shown, the robotic unwind stand 10 is generally rectangular. In various embodiments, other configurations may be used, such as a cube shape or a triangular shape, for example. The robotic unwind stand 10 may have a plurality of faces, including a first face 26 and a second face 28. As illustrated, the first face 26 and the second face 28 may be laterally opposed and separated by a distance D. In various embodiments, distance D between first face 26 and the second face 28 may be in the range of about 3 feet to 8 feet or less. A cavity 30 may be defined intermediate the first face 26 and the second face 28. As shown, while the cavity 30 is illustrated as being generally rectangular, it is to be appreciated that the cavity 30 may be a variety of shapes and may largely depend on the relationship of the various faces. For example, if the frame 12 is triangular, the cavity 30 may be generally triangular as well. The cavity 30 may be generally enclosed by the various plates 14 of the robotic unwind stand 10. In order to provide access to components and equipment within the cavity 30, the robotic unwind stand 10 may have at least one cavity access port. Furthermore, a door may be mounted in the cavity access port to control access to the cavity 30. It is preferred that any door be sized to allow a person to enter the cavity 30. Various embodiments may comprise a plurality of doors and a plurality of cavity access ports.

In some embodiments, the robotic unwind stand 10 can include a first splicer 42. The first splicer 42 may be positioned on the robotic unwind stand 10 in any suitable location, such as prior to any web materials contacting first lattice 62. As illustrated in FIG. 2, the first splicer 42 may be configured to receive a web material 46 and a web material 48.

A first lattice 62 can be operatively mounted to the frame 12. The first lattice 62 may comprise a plurality of rollers 64 and a complimentary plurality of rollers 66 mounted to the frame 12. As is to be appreciated, the number of rollers 64, 66 in the first lattice 62 may vary depending on the type of web material being fed through the first lattice 62 and the feed speed of the web material 46, 48. The number of rollers 64, 66 in one first lattice 62 may differ from the number of rollers 64, 66 in a second lattice 70, as the number of rollers 64, 66 used can be based on characteristics of the web material 46, 48 being fed through the first lattice 62 such as web material 46, 48.

In some embodiments, the robotic unwind stand 10 may comprise a first and second metering rolls (not shown) or other devices suitable for establishing a line speed and/or a line tension of the web material 46, 48. The first and second metering rolls (not shown) may be driven by an actuator to establish a line speed and/or line tension of the web material 46, 48.

In an exemplary but non-limiting embodiment, a unique feature of the robotic unwind stand 10 is the use of a positionable roll grasping apparatus 100 (or a plurality of positionable roll grasping apparatii 100) that can be provided in the form of a robot 110 to move, relocate, position, unwind, remove, and/or otherwise herein provide the various convolutely wound rolls of first and/or second web materials 46, 48 relative to the robotic unwind stand 10 or any component generally associated with the converting of convolutely wound rolls of first and/or second web materials 46, 48 such as splicer 42 or first lattice 62, or even another convolutely wound roll of first and/or second web materials 46, 48 (generally referred to herein as "dispose"). It would be understood by one of skill in the art that a positionable roll grasping apparatus 100 in the form of a robot 10 can provide capabilities that can generally range from simple repetitive point-to-point motions to complex motions that can be computer controlled and sequenced as part of the robotic unwind stand 10. While positionable roll grasping apparatus 100 is provided in exemplary, non-limiting form herein as a robot 110 herein, one of skill in the art will appreciate that positionable roll grasping apparatus 100 could be provided in other forms such as a series of connected mechanical linkages, autonomous devices, and the like.

An exemplary robot 110 can be provided with an arm 120 (or an inter-connected plurality thereof), a wrist subassembly 130 and an end effector 140. An exemplary robot 110 could utilize a Cartesian, cylindrical, polar, or revolute coordinate system to coordinate motion relative to the robotic unwind stand 10, the various first and second web materials 46, 48, as well as the components each cooperatively associated thereto. One of skill in the art will recognize that generally, three motion axes are employed to deliver the wrist subassembly 130 anywhere within the sphere of influence and three additional motion axes are employed for universal orientation of the end effector 140. A drive system can be used for each motion axis, and without limitation the drive system can be electrical, hydraulic or pneumatic.

The exemplary robot 110 represented in the drawings provided herein consists of a mount 115, a rocker 125, an extension arm 135 (or an inter-connected plurality thereof), a wrist subassembly 130, as well as an end effector (also called a robot hand) 140 and can be provided with as many as six or seven rotary axes. The axes are different with respect to the swinging and rotating axes, whereby the swinging axes in the robot 110 run crosswise to the extension of the robot 110 structure, and as a rule, horizontally. The swinging angles are for the most part also limited. The rotational axes generally extend lengthwise to the respective robot structure or in the vertical plane. They permit as a rule greater rotational angles than the swinging axes. Further, rocker 125 can rotate around one or several axes. Further, and by way of non-limiting embodiment, the robot 110 can be arranged in any position, whereby it is, for example, mounted to a support, suspended at a portal, or can be attached to the frame 12.

Alternatively, robot 110 could be provided as a Cartesian coordinate robot (also called a linear robot, or a gantry robot) as well as selective-compliance-articulated robot arms (SCARAs). Exemplary Cartesian coordinate robots and SCARAs can be used to move, relocate, position, and/or otherwise provide the various convolutely wound rolls of first and/or second web materials 46, 48 to the robotic unwind stand 10. Cartesian robots are mechatronic devices that use motors and linear actuators to position a tool. They make linear movements in three axes—X, Y, and Z. Physical scaffolding can form a framework that anchors and supports the axes and payload. Certain applications, such as machining tightly toleranced parts, require full support of the base axis, usually the X axis. In contrast, other applications, such as picking bottles off a conveyor, require less precision, so the framework only needs to support the base axis in compliance with the actuator's manufacturer recommendations. Cartesian-robot movements stay within the framework's confines, but the framework can be mounted horizontally or vertically, or even overhead in certain gantry configurations.

A gantry robot is a special type of Cartesian robot whose structure resembles a gantry. This structure can be used to minimize deflection along each axis. Many large robots are of this type. The X, Y, and Z coordinates of a gantry robot can be derived using the same set of equations used for the Cartesian robot. One of skill in the art will understand that a SCARA and six-axis robots generally mount on a pedestal or are attached to a frame. SCARAs move in the X, Y, and Z planes like Cartesian robots, but incorporate a theta (θ) axis at the end of the Z plane to rotate the end-of-arm tooling.

One of skill in the art will recognize that the selection of a particular robot is evaluated by the application's needs. That can start with profiling the job's load, orientation, speed, travel, precision, environment and duty cycle, sometimes called the LOSTPED parameters. First, a robot's Load capacity (defined by the manufacturer) should exceed the total weight of the payload, including any tooling, at the end of the robot arm. Second, the Orientation depends on how the robot is mounted and how it situates parts or products being moved. One of skill in the art will understand that a goal is to match the robot's footprint to the work area. Additionally, one of skill in the art will consider part orientation. Third, Speed and Travel should be considered along with load and speed ratings. Fourth, industrial robots have predefined accuracy ratings that make it easy to determine their repeatability of movement. Precision can be a key to high-end applications. Fifth, Environmental factors can dictate the best robot for use. This can include the working envelope's ambient environment and hazards in the space itself. The pedestals of SCARA and six-axis robots can be compact, which is handy with limited floor space. Sixth, the amount of time it takes to complete one cycle of operation (i.e., Duty cycle) should be considered. Robots that run continuously 24/7 (as in high-throughput screening and pharmaceutical manufacturing) reach end of life sooner than those running only 8-hr days, five days a week. Finally, a suitable robot for an application can also depend on the requirements for controls and programmability. All robot controls will preferably be able to interpolate point-to-point, linear, or circular movements through path following and programmed speed, acceleration, and deceleration parameters.

Figure 6:
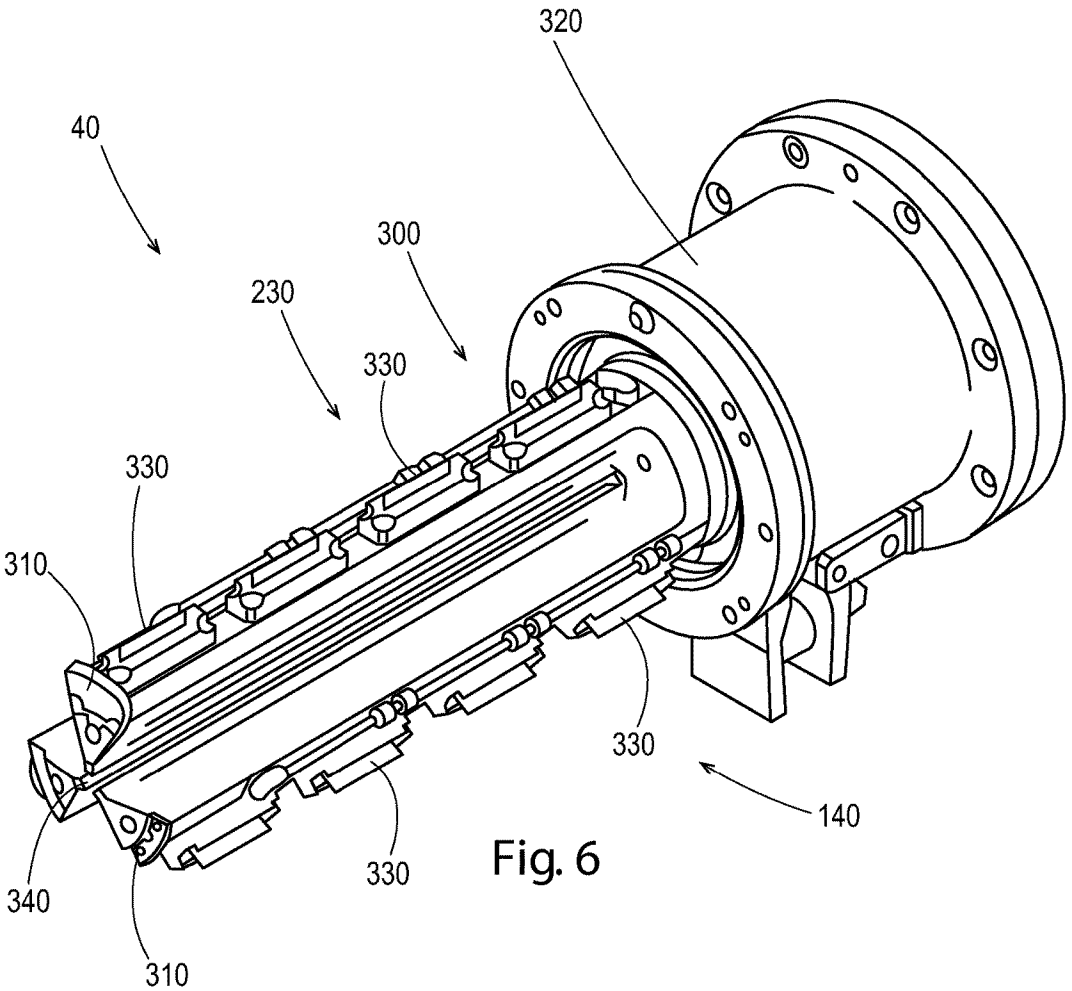
FIG. 6 is a perspective view of an exemplary end effector suitable for use with a 6-axis robot of the disclosed robotic unwind stand; and, FIG. 7 is a perspective view of another exemplary end effector suitable for use with a 6-axis robot of the disclosed robotic unwind stand.

Referring to FIG. 6, end effector 140 (robot hand 140) can be constructed with respect to the kinematics required to move each of the convolutely wound rolls of web materials 46, 48 from a first location to a second location. This may require moving the wound web materials 46, 48 from a first location where the wound web materials are stored to a second location that places the web materials proximate to, or in contacting engagement with frame 12, or placing the web material comprising each of wound web materials 46, 48 proximate to or in contacting engagement with first splicer 42 (or any number of splicers or other equipment associated with the production of disposable absorbent articles such as diapers and catamenial devices). For that matter, robot hand 140 can move each of the convolutely wound rolls of wound web materials 46, 48 into any position or location that provides the wound web material 46, 48 in the most efficacious position required to manufacture the articles envisioned. Additionally, robot hand 140 can be positioned relative to the first splicer 42 (or any number of splicers or other equipment associated with the production of disposable absorbent articles such as diapers and catamenial devices) during the unwinding process. One of skill in the art will recognize that this can provide additional room for the placement of an additional wound web material within the space just evacuated by robot hand 140 or the installation of additional manufacturing equipment that may be required for the production of disposable absorbent articles such as diapers and catamenial devices during the unwinding process.

Additionally, it is envisioned that robot hand 140 can be constructed with respect to the kinematics required to remove the cores upon which the convolutely wound rolls of web materials 46, 48 are wound about. It is also envisioned that robot hand 140 can be provided as a centrally constructed articulating hand. This can provide the robot hand 140 with the three continuous and interlaced axes of rotation (movement). This may require providing as many drive shafts axes that extend inside the housing of extension arm 135. Each drive shaft can be directly attached to a respective motor with cardan links. Such a robot 110 can facilitate the placement of sequential robots 110 arranged directly next to one another with minimal distance and an ability to operate separately without mutually hindering each other.

Additionally, it is envisioned that robot 110 and/or robot hand 140 can automatically and/or autonomously determine any characteristic of a roll of web material such as the diameter of a roll of web material (e.g., first web material 46), the diameter of a core region of a roll of web material, the type of material comprising a roll of web material, a physical characteristic of a roll of web material, or the like through computer control or programming as would be available to one of skill in the art. It is believed that such a determination could be beneficial in allowing the robot 110 to automatically and/or autonomously select an appropriate end effector 140 provided from a selection of available end effectors 140. By way of non-limiting example, if the roll grasping apparatus 100 provided as robot 110 (or any ancillary component of roll grasping apparatus 100) determines that a particular roll of web material (e.g., first web material 46) has a diameter of 1 meter and a core diameter centrally disposed thereto has a diameter of 10 cm, any control software, programming, or other PLC code could direct the robot 110 to obtain an appropriately sized end effector 140 from a store of end effectors 140. Alternatively, if robot 110 has a particular end effector 140 disposed thereon and the control software, programming, or other PLC code determines that an end effector 140 disposed upon robot 110 is incorrectly sized for the roll of web material, the control software, programming, or other PLC code could direct the robot to return the end effector 140 currently disposed thereon to a store of end effectors 140 and select a new and or appropriate end effector 140 for the particular roll of web material. It is believed that such an ability to change end effectors 140 'on-the-fly' would necessarily increase the flexibility of a manufacturing process as well as decrease the amount of time needed to change production of articles from one type requiring one type of web material to another.

More particularly, as shown in FIGS. 1-3, a six-axis industrial electric robot 110 which is illustrative of a wide variety of robots that can be operated in accordance with the principles of the present disclosure. An exemplary robot 110 suitable for use with the present disclosure as positionable roll grasping apparatus 100 is the model KR180L available from Kuka Robotics. By way of non-limiting example, the model KR180L has a 50-60 Kg payload capacity. The Model KR210 has an 80-90 Kg payload capacity and the model KR240L having a payload capacity of 110-120 Kg can also be suitable for use. Such robots 110 can be particularly suited for precise, repetitive tasks.

Figure 5:
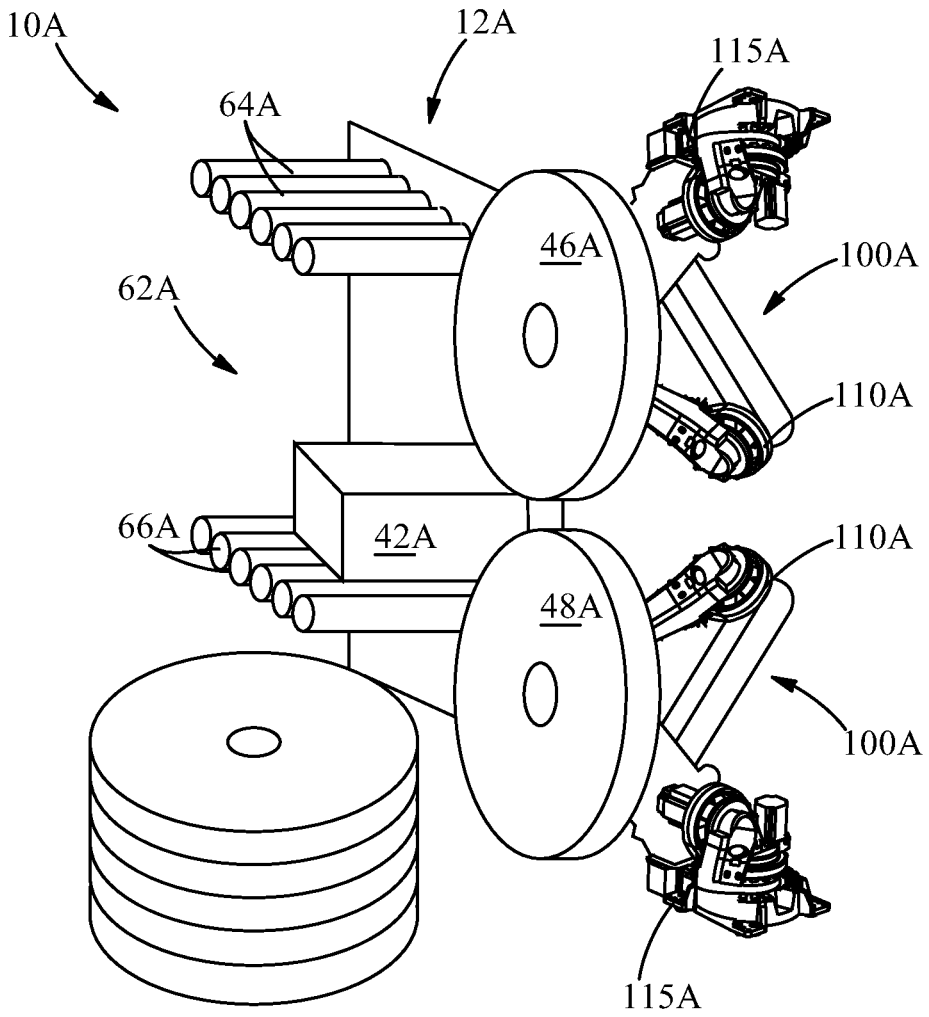
FIG. 5 is a perspective view of an alternative embodiment of an exemplary robotic unwind stand according to the present disclosure showing a plurality of positionable roll grasping apparatii in the form of exemplary 6-axis robots disposed each having a convolutley wound web material disposed thereon and adjacent a first lattice.

As shown in FIG. 5 in another preferred embodiment, positionable roll grasping apparatus 100A (provided as robot 110A), or a plurality of positionable roll grasping apparatii 100A, can be provided in a configuration that is not in connective engagement with frame 12A. In other words, positionable roll grasping apparatus 100A (provided as robot 110A) can be provided with a support assembly for mount 115A that is not physically attached to frame 12A, but is still capable of providing first and second web materials 46A, 48A in cooperative and connective engagement with any of the components of the robotic unwind stand 10A. This can include frame 12A, first splicer 42A, first and/or second dancers (not shown), first and second metering rolls (not shown), or any of idler rollers 64A, 66A disposed upon frame 12A. Each axis of motion of robot 110A can be generated by a brush type DC electric motor, with axis position feedback generated by incremental encoders. By way of example only, robot 110A and the wrist subassembly (not shown) can be provided with any number of articulations, including an up/down rotation, a left/right rotation, a third motion, up and down elbow and shoulder rotations, and a left/right arm rotation on the base 115A of robot 110A.

As would be understood by one of skill in the art, control software can suitably operate the positionable roll grasping apparatus 100 (provided as robot 110) by incorporating absolute position feedback. A suitable robot 110 control scheme can utilize a digital servo control. For example, each robot 110 can be operated with a torque control loop. A position control loop can be connected to a velocity control loop which in turn can drive the torque control loop. A feed-forward acceleration control loop that is responsive to an acceleration command as well as arm and load inertia sensors can be directly coupled to the input of the torque control loop. Additionally, the robot 110, extension arm 135, rocker 125, wrist subassembly 130, and end effector (robot hand) 140 can be operated by the control loop in accordance with a robot program through a stream of program position commands applied to the position control loop. In any regard, it can be preferable to implement such a control loop as a digital control.

A preferred control loop arrangement could provide position and velocity control loops and to be parallel fed to the input of a torque control loop. Velocity commands can be generated from position commands. In turn, feed-forward acceleration commands can be generated from the velocity commands. Computed inertia (extension arm 135, rocker 125, wrist subassembly 130, end effector 140, and the applied load) can be multiplied against the acceleration command in the feed-forward acceleration control loop.

A velocity command generator can interpolate velocity commands which correspond with the velocity feedback sampling rate in a velocity feedback path. Similarly, in a position control loop, an interpolator can generate position commands in correspondence with a feedback path. Velocity error can be generated by a summer with gain applied by a loop. Similarly, a position error can be generated by a summer. Velocity and position errors and feed-forward acceleration command can be summed in a summer. Gain can be applied to generate a torque command that is applied to the input of a torque control loop. The torque error can generated in a summer by summing the torque command (motor current command) with current feedback and applying a torque loop gain to the torque error and output commands (motor voltage commands) that supplies the motor drive current for robot 110 joint operation.

The various components of the robotic unwind stand 10 and or positionable roll grasping apparatus 100 may be powered by any motive force known in the art, collectively referred to herein as "actuators." Power sources include, without being limiting, standard and servo electric motors, air motors, and hydraulic motors. The power source may be coupled to any rotating components of the robotic unwind stand 10 by any power transfer means known in the art, such as direct coupling the actuator to the rotating component, driving the rotating component through the use of chains and sprockets, belts and sheaves, and gearing, for example. The actuators may extend into the cavity 30 of the robotic unwind stand 10. Various power and communication cables may be attached to the actuators inside the cavity 30.

The positionable roll grasping apparatus 100 and/or robot 110 may further comprise roll grasping means in the form of a mandrel 40 (also known as a "spindle") and/or idler rollers capable of providing, engaging and directing the web material first and second web materials 46, 48 into cooperative and connective engagement with any of the components of the robotic unwind stand 10. A mandrel 40 can manifest itself as end effector 140 disposed upon robot 11.

In one embodiment, a convolutley wound roll of the first web material 46 may be mounted on the mandrel 40. The convolutley wound roll of the first web material 46 may be rotatable in either a clockwise and/or counter clockwise direction. The web material 46 may be unwound from the convolutley wound roll and fed into, and passed through, the splicer 42. Once passing through the splicer 42, the web material 46 may enter the first lattice 62. As illustrated, the web material 46 may be looped over a roller 66 and then extend to a roller 64. The web material 46 may then extend between a series of complimentary rollers in the first lattice 62 thereby forming a "festoon."

As will be appreciated upon consideration of this disclosure, the distance between the rollers 64 and the rollers 66 can be increased, thereby increasing the linear amount of the web material 46 engaged in the first lattice 62. Additionally, the number of rollers 64, 66 used in the first lattice 62 can also determine the linear amount of the web material 46 engaged in the first lattice 62. After passing through the first lattice 62, the web material 46 may proceed in the machine direction towards the first metering roll or any downstream operation suitable for the production of disposable absorbent articles such as diapers and catamenial devices. After engaging with first metering roll or other downstream device, the web material 46 may be further directed toward any additionally desired downstream equipment.

A convolutley wound roll of the first web material 46 can be mounted to the mandrel 40. The convolutley wound roll of the first web material 46 may be configured to rotate in a clockwise and/or counterclockwise direction. In the illustrated embodiment, the convolutley wound roll of the second web material 48 can serve as a stand-by roll for the splicer 42, and therefore the second convolutley wound roll of the second web material 48 may be the same type as the convolutley wound roll of the first web material 46. In some embodiments, it may be advantageous to provide convolutley wound roll of the second web material 48 as a different web material than convolutley wound roll of the first web material 46 in order to allow for the ability to rapidly change web material types without having to actually remove the given web material before changing over to different product constructions. In other embodiments, however, the convolutley wound roll of the first web material 46 may bypass the splicer 42 and/or may be a different web material than convolutley wound roll of the second web material 48. As used herein, splicing (and splicing means) refers to any process of joining, or any apparatus or equipment associated with or necessary to join, a first web material to a second web material, such as joining the convolutley wound roll of the first web material 46 to the convolutley wound roll of the second web material 48. As used herein, a splice is considered to be the combined localized portions of a first web material and a second web material that are joined together.

The first and second convolutley wound rolls of web material 46, 48 that may be spliced (with splicing means) can include, without being limiting, non-woven materials, paper webs including tissue, towel and other grades of paper, absorbent materials, plastic films and metal films. The splicer 42 may be adapted to splice the web material of any suitable width and thickness. Web material ranging in width from a few millimeters to about several meters may be processed by an appropriately sized splicing apparatus. Similarly, web material ranging in thickness from a few thousandths of a millimeter to several millimeters may be spliced by an appropriately adapted splicer 42.

It should be understood that first and second convolutley wound rolls of web materials 46, 48, such as thermoplastic material, can be added to the line operation in an alternating fashion in the above described manner whenever a low roll amount is detected, thereby allowing the line to run continuously. It should also be understood that while the method and apparatus of the present invention have been described with reference to first and second web materials, it is intended that multiple rolls of web materials will be spliced together over time to keep the line running. Further, it is contemplated that the first and second web materials need not be made from the same web material as long as the web materials used for the first and second webs are compatible from a splicing standpoint. Due to the ability to continuously run the line operation according to the teachings of the present invention, products can be manufactured with minimal manufacturing down-time.

First lattice 62 may serve as an accumulator during a zero-speed splice and may also serve as part of a dancer roll in order to facilitate and/or alter the line tension of the web materials 46, 48. As is to be appreciated, the robotic unwind stand 10 may comprise a variety of sensors to determine roll diameter and material tension for example. A controller, or plurality of controllers, may be used to receive various inputs from the sensors on manufacturing line and the robotic unwind stand 10 and make adjustments as needed in a continuous and ongoing fashion. Additional detailed descriptions of various types control methods and apparatii can be found in U.S. Pat. Nos. 6,991,144 and 7,028,940, incorporated by reference herein.

First and second convolutley wound rolls of web materials 46, 48 can be provided to the robotic unwind stand 10 through means known to those of skill in the art. For example, first and second convolutley wound rolls of web materials 46, 48 can be provided to the robotic unwind stand 10 through the use of carts (not shown). By way of example only, carts can be provided with a quantity of convolutely wound rolls of web material suitable for use as first and second web materials 46, 48.

During operation, the splicer 42 may perform a zero-speed splice of a tail end of the web material 46 to the leading (or beginning) end of the web material 48 while simultaneously continuing to deliver the web material 46 to any downstream converting equipment. During a splicing operation, the first lattice 62 may move in order to serve as an accumulator and increase the linear amount of the first web material 46 engaged in the first lattice 62. When the convolutley wound roll of the first web material 46 stops spinning, the arm moves or pivots and the web material 46 is drawn out of the first lattice 62 to supply the downstream equipment. Therefore, the splicer 42 may splice the first web material 46 to the second web material 48 while the rolls of the first lattice 62 are stopped, yet the first web material 46 can continue to be delivered from the robotic unwind stand 10 to downstream equipment without disruption. Once the splice has been performed, the mandrel 40 may be rotated by an actuator to unwind the second web material 48 from the convolutley wound roll of the second web material 48. As will be appreciated, once the second web material 48 is unwinding from the convolutley wound roll of the second web material 48 and supplying web material to the downstream equipment, a replacement roll may be loaded onto an opposed mandrel 40, with material from that replacement roll fed into the splicer 42 and positioned to serve as a standby roll.

The splice between the first web material 46 and the second web material 48 may be accomplished by any means known in the art. The nature of the splice may be related to the nature of the particular web material being spliced. In one embodiment two convolutley wound rolls of the web materials 46, 48 can be spliced together by using two-sided splicing tape having adhesive on each side of the tape. In this embodiment, the two-sided splicing tape is affixed first to the first web material 46 and then to a second web material 48. Pressure may be applied to the portion of the two web materials 46, 48 after the application of the two-sided splicing tape. In another embodiment two web materials 46, 48 may be joined by applying an adhesive directly to the first web material 46 and then bringing the second web material 48 into contact with the adhesive. Pressure may be applied to the two web materials 46, 48 at the location of the adhesive to assist in the joining of the web materials 46, 48.

In another embodiment two web materials 46, 48 may be brought into a face-to-face relationship and then subjected to sufficient pressure to bond the two web materials 46, 48 together. In this embodiment, the two web materials 46, 48 may be subjected to sufficient pressure to glassine the two web materials 46, 48 creating a bond sufficient to withstand the process tension applied to the spliced web material.

In another embodiment the two web materials 46, 48 may be brought into a face-to-face relationship and exposed to a bonding means. Bonding means include without being limiting, exposure to infra-red or other electromagnetic radiation to heat and fuse the first and second web materials 46, 48, ultrasonic energy applied from an appropriately adapted ultrasonic horn to the combined web material against an anvil to heat and fuse the first and second web materials 46, 48 together, and the spray application of a solvent to fuse the first and second web materials 46, 48.

In one embodiment, and as shown in FIG. 4, the robotic unwind stand 10 may support additional rolls, such as additional rolls 112. In various embodiments, additional rolls 112 may be configured to operate substantially similar to convolutley wound rolls of the first and second web materials 46, 48. For instance, additional rolls 112 may serve as a supply roll or as a stand-by roll. While rolls of web material 46, 48, 112 are shown, it is to be appreciated that more or less rolls may be used in various embodiments. For example, some embodiments of the robotic unwind stand 10 may include additional vertical sections to accommodate an additional roll or additional rolls. Furthermore, in various embodiments, the robotic unwind stand 10 may include mandrels on other faces that are configured to receive rolls of web material. In one embodiment, the second face 28 may comprise a set of mandrels. Convolutley wound rolls of web material may be mounted on these mandrels and during operation downstream equipment may be continuously fed with web material from at least one of the rolls. It is to be appreciated that in some embodiments the second face 28 of a vertical section 20 may comprise at least one mandrel configured to receive a roll of web material. Further, in some embodiments, the second face 28 of a vertical section 20 may comprise at least two mandrels, with each mandrel configured to receive a roll of web material. Additionally, the second face 28 of any vertical section 20 may comprise a splicer, similar to splicer 42, for example.

Referring again to FIG. 6, it is believed that if mandrel 40 is provided as an end effector (robot hand) 140, mandrel 40 can be provided with a unique device that provides for the ability to transfer convolutely wound rolls of web materials without the need for compressional forces applied to the external convolutions of the wound web materials.

Because of the compressible nature of the web materials, it is quite common for parent rolls to become out-of-round. Not only the soft nature of the web material, but also the physical size of the rolls, the length of time during which the rolls are stored, how the rolls are stored (e.g., on their end or on their side), and the fact that 'roll grabbers' used to transport these rolls clamp the roll generally about the circumference all can contribute to this problem. As a result, by the time many rolls are placed on an unwind stand for converting, they have changed from the desired cylindrical shape to an 'other-than-round' (e.g., out-of-round) shape.

In extreme cases, rolls can become oblong, assume an ' egg-like' shape, or even resemble a flat tire. But, even when the roll is only slightly out-of-round, there are considerable problems. In an ideal case, as material is removed from a completely round, convolutely wound roll, the feed-rate, web velocity, and tension will generally be consistent. However, process disturbances such as the feed-rate variability, web velocity variability, and tension variability for an out-of-round, convolutely wound roll, caused by the shape changes created by the storage and handling of rolls, will likely vary the material removal from the ideal web speed of a completely round roll depending upon the position and/or radius at the web takeoff point at any moment in time.

If the rotational speed of the roll remains substantially constant, the feed-rate, web velocity, and tension of the web material coming off of an out-of-round roll will vary during any particular rotational cycle. Naturally, this depends upon the degree to which the roll is out-of-round. Since the paper converting equipment downstream of the unwind stand is generally designed to operate based upon the assumption that the feed-rate, web velocity, and tension of web material coming off of a rotating roll is generally consistent with the driving speed of the roll, web velocity, and/or tension spikes, and/or slackening during the unwinding process can cause significant problems. With an out-of-round roll, such process disturbances cause the instantaneous feed-rate, web velocity, and/or tension of the web material to be dependent upon the relationship at any point in time of the radius at the drive point and the radius at the web takeoff point.

Clearly, there is a need to overcome this problem of causing out-of-round convolutely wound rolls of web material. Particularly, out-of-round rolls create variable web feed rates and corresponding web tension spikes and web tension slackening that have required that the unwind stand and associated paper converting equipment operating downstream thereof be run at a slower speed. In many instances this creates an adverse impact on manufacturing efficiency. Providing an end effector 230 as discussed herein can obviate these aforementioned drawbacks.

FIG. 6 provides a perspective view of an end effector 140 suitable for use as a mandrel 40 for unwinding convolutely wound rolls of web material 46, 48, 112 that can be conjoined to robot 110. By non-limiting example, end effector 140 is provided as a mandrel 40 having a plurality of elongate mandrel arms 310 disposed radially about the longitudinal axis 340 of mandrel 300 and extending from mandrel shaft 320. Each mandrel arm 310 is provided with at least one expansion element 330, and in most cases a plurality of expansion elements 330 disposed upon the outer surface thereof. In principle, mandrel 300 is inserted into the hollow core area of a convolutley wound material. The associated expansion elements 330 associated with each mandrel arm 310 are then expanded radially away from longitudinal axis 340. The outward expansion of the expansion elements 310 is limited by the diameter of the hollow core area of the convolutely wound web material. Upon proper expansion of the expansion elements 310 against the hollow core of the convolutely wound web material, a compression fit is realized that effectively provides the end effector 140 having the convolutely wound web material attached thereto to freely move about and position the roll of convolutely wound web material be positioned as may be required.

As depicted, mandrel 40 can be provided as a suitable end effector 140 with three mandrel arms 310 arranged triangularly about longitudinal axis 340. Naturally, one of skill in the art could provide a mandrel 300 with any number of mandrel arms 310 disposed as required about longitudinal axis 340. For example, one of skill in the art could provide only two mandrel arms 310 or even four mandrel arms 310.

One surprising aspect of providing mandrel 300 as a plurality of mandrel arms 310 is the ability to interleave a pair of mandrels 300. In other words, the mandrels arms 310 of opposed mandrels 300 can be disposed in an adjoining relationship so that the mandrel arms 310 of interlaced mandrels 300 are disposed radially and cooperatively about longitudinal axis 340 and in cooperative engagement with each other. A surprising benefit of such interleaving is the ability to effectively transfer a convolutley wound roll of web material disposed and locked upon a first mandrel 300 to be transferred to a second mandrel 300 upon the inter-engagement of the mandrel arms 310 of a first mandrel 300 and the mandrel arms 310 of a second mandrel 300.

It is believed that the respective expansion elements 330 can be expanded and contracted though the use of appropriate valving and fluid supply. Suitable fluids could be provided as a hydraulic control system or an air control system. In certain cases, it may be suitable to provide valves that can control and/or direct the flow of fluid to control a particular expansion element 330 or plurality of expansion elements 330 as may be required by the user. In any regard, it is preferred that the expansion elements 330 be expandable to the point of contacting engagement with the material defining the outside of the hollow core of the convolutley wound web material. The amount of contacting engagement should be sufficient to allow for the mandrel 300 provided as an end effector 140 of robot 110 provided as a mandrel 40 can effectively position or unwind the convolutley wound roll of the first web material 46 without loss of control of the convolutley wound roll of the first web material 46.

Figure 7:
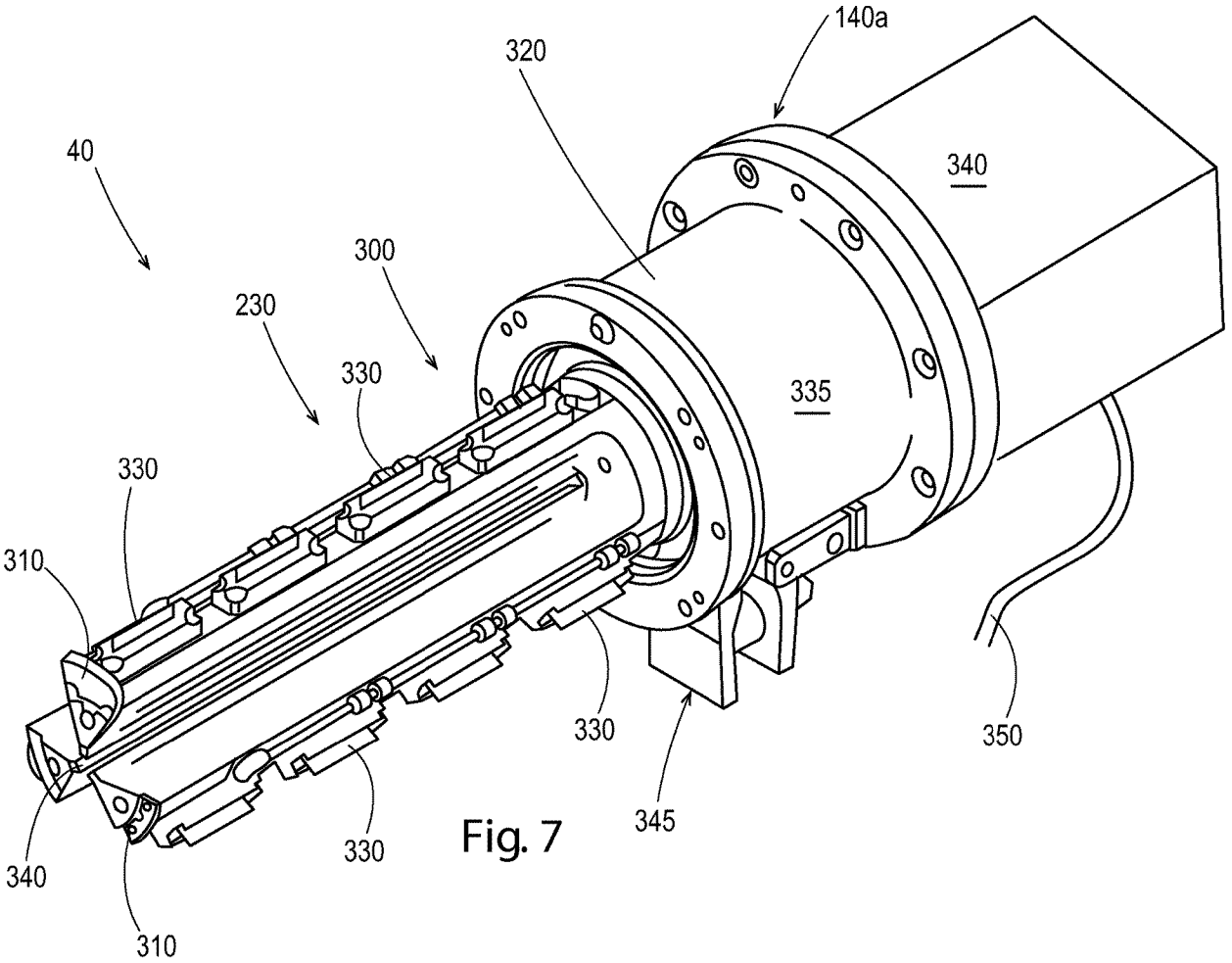

FIG. 7 provides a perspective view of an alternative embodiment of an end effector 140*a* suitable for use as a mandrel 40 for unwinding convolutely wound rolls of web material 46, 48, 112 that can be conjoined to robot 110. By non-limiting example, end effector 140*a* can be provided as a mandrel 40 similar to that of FIG. 6 (described supra) by having three mandrel arms 310 arranged triangularly about longitudinal axis 340. Naturally, one of skill in the art could provide a mandrel 300 with any number of mandrel arms 310 disposed as required about longitudinal axis 340. For example, one of skill in the art could provide only two mandrel arms 310 or even four mandrel arms 310. Further, end effector 140*a* can be attached to robot 110 electrically, mechanically, magnetically, or any other means of attachment known to those if skill in the art through mounting bracket 345.

End effector 140*a* can be coupled to a rotational coupling 335. As would be understood by one of skill in the art, rotational coupling 335 can provide the enablement of a rotational mandrel 40 with a stationary motor 340. By way of non-limiting example, a suitable rotational coupling 335 can comprise a housing that is essentially two bearings operatively disposed within a fixed outer metal block that is mounted to the stationary motor 340 and robot 115. Suitable bearings are available from SKF as BEARING D25X52X15—SKF W 6205.2RSL.

Additionally, end effector 140 can utilize rotational coupling 335 to provide any required power, pneumatics, and the like to the mandrel 40 necessary to hold convolutely wound rolls of web material 46, 48, 112. By way of non-limiting example, a suitable pneumatic coupling could be provided as a through bore or an end-cap style. If so desired, it may also be useful to use an offset pulley and/or drive system to enable pneumatic coupling. Such a component can be provided as ROTATING JOINT—PART NO. R.037, available from OMPI S.R.L., DENVER, COLORADO. It was found that an end cap style pneumatic coupling was suitable with for use as rotational coupling 335 as well as providing an off-set stationary motor 340 (and accompanying drive shaft). Such an off-set design could be provided by one of skill in the art through a belt/pulley system. This arrangement could result in a need for less space as may be conventionally required for end effector 140.

One of skill in the art would find that a suitable motor 340 is available from Rockwell, Incorporated and is identified as an MPM Motor, MultiTurn Encoder, SpeedTec, With Brake, 7.2 Kw, 3000 RPM, Rockwell Part ##MPM—B2153F-MJ74AA. Those of skill in the art will realize the need to also any supply drives, cables, converters, adapters, and the like that can facilitate connection of the stationary motor 340 to be connected to, and controlled by, a logic processor. Such additional components suitable for use with the specified motor 340 can include: Power cable from drive to plug board, Motor Power Cable, SpeedTec Din, w/Brake 2M, Rockwell Part #2090-CPBM7DF-08AF02; Power Cable from plug board to motor, Motor Power Cable, SpeedTec Din, w/Brake 10M (Patch Cable), Rockwell Part #2090-CPBM7E7-08AA10; Feedback back from drive to plug board, Motor Feedback Cable, SpeedTec Din 2M, Rockwell Part #2090-CFBM7DF-CDAF02; Feedback cable form plug board to motor, Motor Feedback Cable, SpeedTec Din 10M (Patch Cable), Rockwell Part #2090-CPBM7DF-08AF02; Bulkhead Adapter Kit for Feedback Cable, Rockwell Part #2090-KPB47-12CF; and, Bulkhead Adapter Kit for Power Cable, Rockwell Part #2090-KPB47-06CF. A suitable drive for motor 340 is available from Rockwell, Incorporated as: Kinetix 5500, Rockwell Part #2198H070ERS with ancillary equipment noted as Feedback converter for MPM motor, Rockwell Part #2198H2DCK, Control power connector, Rockwell Part ##2198H070PT, and DC Bus Connector, Rockwell Part ##2198H070DT.

It is believed that the respective expansion elements 330 of mandrel 40 can be expanded and contracted though the use of appropriate valving and fluid supply 350. Suitable fluids could be provided as a hydraulic control system or an air control system. In certain cases, it may be suitable to provide valves that can control and/or direct the flow of fluid to control a particular expansion element 330 or plurality of expansion elements 330 as may be required by the user. In any regard, it is preferred that the expansion elements 330 be expandable to the point of contacting engagement with the material defining the outside of the hollow core of the convolutley wound web material. The amount of contacting engagement should be sufficient to allow for the mandrel 300 provided as an end effector 140 of robot 110 provided as a mandrel 40 can effectively position or unwind the convolutley wound roll of the first web material 46 without loss of control of the convolutley wound roll of the first web material 46.

One of skill in the art will understand that the use of end effector 140*a*, the need to "hand-off" convolutely wound rolls of web material 46, 48, 112 is eliminated. For example, robot 110 can directly obtain a new convolutely wound roll of web material 46, 48, 112 prior to any necessary process positioning to dispose to any downstream converting operations. Further, when the convolutely wound rolls of web material 46, 48, 112 has been used to completion, 110 robot can directly dispose of the old convolutely wound roll of web material 46, 48, 112 and would requires no transfer of the convolutely wound roll of web material 46, 48, 112 between equipment. One of skill in the art will recognize that the elimination of such a "hand-off" can result in the elimination of normally attributable manual operations resulting in productivity and cost savings. Ostensibly, this is because the use of a robotic unwind incorporating a so-called 'all-in-1' unwind operation would naturally include elimination of such roll "hand-offs" resulting in the aforementioned efficiency and productivity. Additionally, it is envisioned that the use of an unwind incorporating robot 110 having end effector 140*a* cooperatively engaged thereto can result in better management of any process space efficiency due to a robot 110 being an integral part of any unwind operations. Further, one of skill in the art will readily appreciate the increased flexibility, repeatability, and reliability in the positioning of convolutely wound rolls of web material 46, 48, 112 relative to any converting operations downstream from the robot 110 unwinding operation.

Incorporating a mandrel 140*a* as discussed supra can provide the ability for the robot 110 to be positionable to locate a new convolutely wound rolls of web material 46, 48, 112 or similarly locate the core of a new convolutely wound rolls of web material 46, 48, 112. In this fashion, the robot 110 with end effector 140*a* having mandrel 40 can engage the core of the convolutely wound rolls of web material 46, 48, 112 and utilize suitable pneumatics (discussed supra) to engage and secure the new roll of convolutely wound roll of web material 46, 48, 112.

The robot 110 can then move the convolutely wound roll of web material 46, 48, 112 secured thereto to a load position relative to a desired location suitable for a converting operation such as splicer 42, first lattice 62, or the like. Upon the proper positioning of convolutely wound rolls of web material 46, 48, 112 disposed upon robot 110/end effector 140*a* relative to the load position, stationary motor 340 can engage rotational coupling 335 to cause mandrel 40 to rotate relative to the desired converting operation causing the material comprising convolutely wound rolls of web material 46, 48, 112 to be unwound from convolutely wound rolls of web material 46, 48, 112 and directed toward the desired converting operation.

As required an automated or non-automated system can present the leading edge of the material comprising convolutely wound roll of web material 46, 48, 112 to the splicer 42 or other desired converting operation. As required, one of skill in the art can cause robot 110 and/or mandrel 40 to further position convolutely wound roll of web material 46, 48, 112 relative to the converting operation as well as provide the required tension to the material comprising convolutely wound rolls of web material 46, 48, 112. In a typical converting operation, the material from convolutely wound roll of web material 46, 48, 112 can be spliced together with a tail end of a previously used or currently used convolutely wound roll of web material 46, 48, 112 by splicer 42 and then utilized as required by the demands of the converting operation.

During the unwinding process, it is believed that the position of robot 110 can be adjusted as necessary. Movement of convolutely wound roll of web material 46, 48, 112 during unwinding can facilitate the creation of the space necessary for a second robot 110 to position yet another convolutely wound roll of web material 46, 48, 112 proximate to splicer 42, for example. As the currently unwinding convolutely wound roll of web material 46, 48, 112 approached the end of the material disposed thereon due to unwinding, the new convolutely wound roll of web material 46, 48, 112 can be joined to the currently unwinding convolutely wound roll of web material 46, 48, 112 in a fashion consistent with that as described supra. After such a splice event, the robot 110 having a mandrel 40 cooperatively attached thereto can then dispose of the remains of the previously roll of convolutely wound roll of web material 46, 48, 12 as required by the manufacturing operation, such as a disposal bin.

Referring again to FIG. 4, another embodiment of the robotic unwind stand 10*a* is illustrated. The robotic unwind stand 10*a* is provided with a frame 12*a*. The frame 12*a* includes various components, such as structural supports and plates. As shown, the robotic unwind stand 10*a* may have a plurality of faces, including a first face 26*a* and a second face 28*a*. A cavity 30*a* may be defined intermediate the first face 26*a* and the second face 28*a*.

The robotic unwind stand 10*a* may comprise a plurality of mandrels 40*a* each extending from a respective positionable roll grasping apparatus 100*a* (provided as robot 110*a*) mounted to frame 12*a*. The mandrels 40*a* may each extend generally perpendicular to the first face 26*a*, or may be positioned at any other suitable angle according to the positioning data provided to positionable roll grasping apparatus 100 (provided as robot 110). In one embodiment, the robotic unwind stand 10*a* includes a plurality of first splicers 42*a*. Each of the first splicers 42*a* can be positioned on, or relative to, the robotic unwind stand 10*a* in any suitable location, such as above a given pair of positionable roll grasping apparatuses 100*a*. As illustrated in FIG. 4, the first splicer 42*a* may be configured to receive a web material 48*a*. Similarly, any other first splicer 42*a* may be configured to receive a web material 46*a*, 48*a*, 112*a*.

The exemplary robotic unwind stand 10*a* of FIG. 4 may further comprise a first lattice 62*a* disposed above a first mandrel pair 40*a*. The first lattice 62*a* may comprise a plurality of rollers 64*a* and a complimentary plurality of rollers 66*a* mounted to the frame 12*a*. The number of rollers 64*a*, 66*a* in the first lattice 62*a* may vary depending on the type of web material being fed through the first lattice 62*a* and the feed speed of the web material 46*a*, 48*a*, 112*a*. A second lattice 72*a* may similarly comprise a plurality of rollers 74*a* and a plurality of rollers 76*a* mounted to the frame 12*a* disposed above a second pair of positionable roll grasping apparatus 100*a* each having a respective mandrel

40*a*. The number of rollers in the first lattice 62*a* may differ from the number of rollers in the second lattice 72*a*, as the number of rollers used is based on characteristics of the web material being fed through the lattices 62*a*, 72*a*, such as web material 46*a*, 48*a*.

In one embodiment, a convolutely wound roll of the second web material 48*a* may be mounted on a respective mandrel 40*a* of a corresponding respective positionable roll grasping apparatus 100*a*. The second web material 48*a* may be unwound from a convolutely wound roll of second web material 48*a* and fed into and passed through the first splicer 42*a*. Once passing through the first splicer 42*a*, the web material 48*a* may enter the first lattice 62*a*. As illustrated in FIG. 4, the web material 48*a* may be looped over a roller 66*a* and then extend to a roller 64*a*. The web material 48*a* may then extend between a series of complimentary rollers in the first lattice 62*a* thereby forming a "festoon." The web material 48*a* may be directed toward downstream equipment.

First and second web materials 46*a*, 48*a* can be provided to the robotic unwind stand 10*a* through means known to those of skill in the art. For example, as shown, first and second web materials 46*a*, 48*a* can be provided to the robotic unwind stand 10*a* through the use of carts (not shown). By way of example only, the carts can be provided with a quantity (i.e., a plurality) of convolutely wound rolls of web material suitable for use as first and second web materials 46*a*, 48*a*, 112*a*.

Further, the robotic unwind stand 10*a* may include mandrels 40*a* extending from a respective positionable roll grasping apparatuses 100*a* on other faces, such as second face 28*a*, of robotic unwind stand 10*a* that are configured to receive convolutely wound rolls of web material. In one embodiment, the second face 28*a* may comprise a set of mandrels (not shown) operatively connected to a respective robot 110*a*. Convolutely wound rolls of web material may be mounted on these additional mandrels and during operation downstream equipment may be continuously fed with web material from at least one of the convolutely wound rolls of web materials. It is to be appreciated that in some embodiments the second face 28*a* may comprise at least one positionable roll grasping apparatus 100/mandrel 40*a* pair configured to receive a roll of convolutley wound roll of web material. Further, in some embodiments, the second face 28*a* may comprise at least two respective positionable roll grasping apparatuses 100*a*/mandrel 40*a* pairs, each mandrel configured to receive a respective convolutley wound roll of web material. Additionally, the second face 28*a* may comprise a splicer, similar to splicer 42*a*, for example.

A respective robot 110*a* can provide the various first and second web materials 46*a*, 48*a* to the robotic unwind stand 10*a*. In one non-limiting example, a six-axis industrial electric robot 110*a* was found suitable. In a preferred embodiment, a robot 110*a* is provided in a configuration that is cooperatively disposed upon frame 12*a*. In other words, robot 110*a* can be provided with a support assembly that is physically attached to frame 12*a* and is still capable of loading, unloading, and/or unwinding the first and second convolutley wound web materials 46*a*, 48*a* in cooperative and connective engagement with any of the components of the robotic unwind stand 10*a*. This can include frame 12*a*, first splicers 42*a*, any additional splicers, any correlated dancers, first and second metering rolls, or any of the idler rollers (e.g., rollers 64*a* and/or rollers 66*a*) disposed upon frame 12*a*.

First and second convolutely wound web materials 46*a*, 48*ab* can be provided to the robotic unwind stand 10*b* through the use of carts (not shown). By way of example only, the carts can be provided with a quantity of convolutely wound rolls of web material suitable for use as first and second web materials 46*b*, 48*b*.

In another preferred embodiment, each respective positionable roll grasping apparatus 100*a* is provided in a configuration that is cooperatively disposed adjacent 12*b*. In other words, positionable roll grasping apparatus 100*a* (provided as robot 110*a*) is not physically attached to frame 12*a* and is still capable of providing first and second convolutely wound web materials 46*a*, 48*a* in cooperative and connective engagement with any of the components of the robotic unwind stand 10*a*. However, one of skill in the art would recognize that any respective positionable roll grasping apparatus 100*a*, provided as robot 110*a* could be physically attached to frame 12*a* and be capable of providing first and second convolutely wound web materials 46*a*, 48*a* in cooperative and connective engagement with any of the components of the robotic unwind stand 10*a*.

All publications, patent applications, and issued patents mentioned herein are hereby incorporated in their entirety by reference. Citation of any reference is not an admission regarding any determination as to its availability as prior art to the claimed invention.

The dimensions and/or values disclosed herein are not to be understood as being strictly limited to the exact numerical values recited. Instead, unless otherwise specified, each such dimension and/or value is intended to mean both the recited dimension and/or value and a functionally equivalent range surrounding that dimension and/or value. For example, a dimension disclosed as "40 mm" is intended to mean "about 40 mm".

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A web unwind stand for obtaining, loading, splicing, and unwinding convolutely wound rolls of web material and forwarding said web material unwound from each of said convolutely wound rolls uninterruptedly to a downstream apparatus, said unwind stand comprising:

splicing means;

a first positionable roll grasping apparatus for obtaining and disposing a first of said convolutely wound rolls proximate to, and relative to, said splicing means, wherein said first positionable roll grasping apparatus comprises:

an articulable arm having a mandrel disposed thereon, said articulable arm being extendable from a first position where said mandrel is in cooperative alignment with said splicing means and a second position proximate to a first of said plurality of convolutely wound rolls of web material, said first of said plurality of convolutely wound rolls of web material not being in operative connection with said splicing means at said second position, and roll grasping means attached to said articulable arm for grasping said first of said plurality of convolutely wound rolls of web material, said roll grasping means including an arm movable radially toward and radially away from said mandrel, wherein said roll grasping means comprises means for revolvingly unwinding said first of said plurality of convolutely wound rolls of web material relative to said splicing means; and a second positionable roll grasping apparatus for obtaining and disposing a second of said convolutely wound rolls proximate to, and relative to, said splicing means.

2. The unwind stand of claim 1, wherein said positionable roll grasping apparatus further comprises means for operating said positionable roll grasping apparatus so as to effect engagement and disengagement of said positionable roll grasping apparatus with said first of said plurality of convolutely wound rolls of web material, including means for synchronously moving said roll grasping means relative to said mandrel.

3. The unwind stand of claim 1, wherein said positionable roll grasping apparatus further comprises control means for controlling said positionable roll grasping apparatus so as to effect movement of said positionable roll grasping apparatus away from alignment with said splicing means and to effect coordinated movement of said positionable roll grasping apparatus while said mandrel and said positionable roll grasping apparatus is engaged with said first of said plurality of convolutely wound rolls of web material so that said first of said plurality of convolutely wound rolls of web material is capable of being moved relative to said splicing means.

4. The unwind stand of claim 1 wherein said second positionable roll grasping apparatus further comprises a second mandrel associated thereto for obtaining said second of said convolutely wound rolls.

5. The unwind stand of claim 4 wherein said second positionable roll grasping apparatus further comprises an articulable arm, said articulable arm being extendable from a second first position in cooperative alignment with said splicing means and a second position proximate to a second of said plurality of convolutely wound rolls of web material, said second of said plurality of convolutely wound rolls of web material not being in operative connection with said splicing means at said second position.

6. The unwind stand of claim 1 further comprising a web accumulator means intermediate a forwarding means and said splicing means.

7. The unwind stand of claim 6 wherein said accumulator means includes a moveable web loading dancer assembly comprising a plurality of idler rollers defining a looped path of variable length for said web, the length of said path being inversely related to the displacement of said dancer assembly above the lower end of its range of travel.

8. The unwind stand of claim 1 wherein said convolutely wound rolls are positionable while said convolutely wound roll is unwinding.

9. The unwind stand of claim 1 wherein said convolutely wound rolls can be oriented positionably relative to said splicing means in at least 3 axis.

10. The unwind stand of claim 1 wherein said convolutely wound rolls can be rotated positionably relative to said splicing means in at least 3 axis.

11. A web unwind stand for obtaining, loading, splicing, and unwinding web material from a succession of convolutely wound rolls of web material and forwarding said web material unwound from each of the convolutely wound rolls uninterruptedly to a downstream apparatus at substantially constant velocity under substantially constant tension, said apparatus comprising:

a frame;

splicing means;

a first positionable roll grasping apparatus comprising a mandrel associated thereto for disposing a first of said convolutely wound rolls proximate to said splicing means relative to said frame;

an articulable arm having said mandrel disposed thereon, said articulable arm being extendable from a first position where said mandrel is in cooperative alignment with said splicing means and a second position proximate to a first of said plurality of convolutely wound rolls of web material, said first of said plurality of convolutely wound rolls of web material not being in operative connection with said splicing means at said second position, and roll grasping means attached to said articulable arm for grasping said first of said plurality of convolutely wound rolls of web material, said roll grasping means including an arm movable radially toward and radially away from said mandrel, wherein said roll grasping means comprises means for revolvingly unwinding said first of said plurality of convolutely wound rolls of web material relative to said splicing means; and, a second positionable roll grasping apparatus for obtaining and disposing a second of said convolutely wound rolls proximate to said splicing means relative to said frame.

12. The unwind stand of claim 11 wherein said convolutely wound rolls can be oriented positionably relative to said splicing means in at least 3 axis and rotated positionably relative to said splicing means in at least 3 axis.

13. The unwind stand of claim 11 further comprising a web accumulator.

14. The unwind stand of claim 11 wherein said first positionable roll grasping apparatus further comprises control means for controlling said first positionable roll grasping apparatus so as to effect movement of said first positionable roll grasping apparatus away from alignment with said splicing means and to effect coordinated movement of said first positionable roll grasping apparatus while said mandrel and said first positionable roll grasping apparatus is engaged with said first of said plurality of convolutely wound rolls of web material so that said first of said plurality of convolutely wound rolls of web material is capable of being moved relative to said splicing means.

15. The unwind stand of claim 14, wherein said first positionable roll grasping apparatus further comprises means for operating said first positionable roll grasping apparatus so as to effect engagement and disengagement of said first positionable roll grasping apparatus with said first of said plurality of convolutely wound rolls of web material, including means for synchronously moving said roll grasping means relative to said mandrel.

16. The unwind stand of claim 11 wherein said convolutely wound rolls are positionable while said convolutely wound roll is unwinding.

* * * * *